US010730294B2

(12) United States Patent
Funabashi et al.

(10) Patent No.: US 10,730,294 B2
(45) Date of Patent: Aug. 4, 2020

(54) LIQUID-DISCHARGE-HEAD SUBSTRATE, LIQUID DISCHARGE HEAD, AND METHOD FOR MANUFACTURING LIQUID-DISCHARGE-HEAD SUBSTRATE

(71) Applicant: CANON KABUSHIKI KAISHA, Tokyo (JP)

(72) Inventors: Tsubasa Funabashi, Yokohama (JP); Takahiro Matsui, Yokohama (JP); Yoshinori Misumi, Tokyo (JP); Maki Kato, Fuchu (JP); Yuzuru Ishida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/271,146

(22) Filed: Feb. 8, 2019

(65) Prior Publication Data

US 2019/0255844 A1 Aug. 22, 2019

(30) Foreign Application Priority Data

Feb. 22, 2018 (JP) ..... 2018-030193
Jan. 11, 2019 (JP) ..... 2019-003804

(51) Int. Cl.
*B41J 2/14* (2006.01)
*B41J 2/16* (2006.01)

(52) U.S. Cl.
CPC ..... *B41J 2/14072* (2013.01); *B41J 2/14* (2013.01); *B41J 2/1433* (2013.01); *B41J 2/14129* (2013.01); *B41J 2/162* (2013.01); *B41J 2/1603* (2013.01); *B41J 2/1626* (2013.01); *B41J 2/1628* (2013.01); *B41J 2/1631* (2013.01); *B41J 2/1642* (2013.01); *B41J 2/1645* (2013.01); *B41J 2/1646* (2013.01); *B41J 2002/14491* (2013.01); *B41J 2202/20* (2013.01); *B41J 2202/22* (2013.01)

(58) Field of Classification Search
CPC .. B41J 2/14072; B41J 2/14129; B41J 2/1433; B41J 2/1603; B41J 2/162; B41J 2/1626
See application file for complete search history.

(56) References Cited

U.S. PATENT DOCUMENTS 6,512,284 B2 * 1/2003 Schulte ..... B41J 2/1412 257/209
2004/0085405 A1 * 5/2004 Baek ..... B41J 2/14072 347/59

(Continued)

FOREIGN PATENT DOCUMENTS

JP 2014-124920 A 7/2014

*Primary Examiner* — Kristal Feggins
*Assistant Examiner* — Kendrick X Liu
(74) *Attorney, Agent, or Firm* — Canon U.S.A., Inc. IP Division

(57) ABSTRACT

A liquid-discharge-head substrate includes a first covering portion covering a first heating resistance element and having electrical conductivity, a second covering portion covering a second heating resistance element and having electrical conductivity, a fuse, and a common wiring line for electrically connecting the first and second covering portions. The common wiring line is electrically connected with the first covering portion via the fuse. The common wiring line and the fuse each have a multilayer structure including a stack of a plurality of conductive layers including a first conductive layer and a second conductive layer that is less oxidizable than the first conductive layer.

19 Claims, 10 Drawing Sheets

(56) References Cited

U.S. PATENT DOCUMENTS

| | | | | |
|---|---|---|---|---|
| 2014/0184703 | A1* | 7/2014 | Hatsui | B41J 2/14129 347/62 |
| 2017/0305168 | A1* | 10/2017 | Coventry | B41J 2/14129 |
| 2019/0255850 | A1 | 8/2019 | Kato et al. | |

* cited by examiner

LIQUID-DISCHARGE-HEAD SUBSTRATE, LIQUID DISCHARGE HEAD, AND METHOD FOR MANUFACTURING LIQUID-DISCHARGE-HEAD SUBSTRATE

BACKGROUND

Field

The present disclosure relates to a liquid-discharge-head substrate included in a liquid discharge head that discharges a liquid, to the liquid discharge head, and to a method for manufacturing the liquid-discharge-head substrate.

Description of the Related Art

Many of the currently used liquid discharge apparatuses each include a liquid discharge head that discharges liquid droplets from discharge ports using bubble generating energy, which is produced by energizing heating resistance elements to heat a liquid in a liquid chamber and cause film boiling of the liquid. In printing by such a liquid discharge apparatus, a region over the heating resistance elements may be affected by physical action, such as cavitation impact that is caused by bubble generation, shrinkage, and disappearance in the liquid in the region over the heating resistance elements. The region over the heating resistance elements may further be affected by chemical action, such as solidification and deposition of components of the liquid on the heating resistance elements, because when the liquid is discharged, the heating resistance elements are at a high temperature and the liquid thus undergoes thermal decomposition. To protect the heating resistance elements from the physical action and the chemical action, a protective layer is disposed to cover the heating resistance elements.

The protective layer is typically positioned in contact with the liquid. Electricity flowing through the protective layer causes an electrochemical reaction between the protective layer and the liquid, so that the protective layer may be degraded. To prevent electricity to be supplied to the heating resistance elements from partly flowing to the protective layer, an insulating layer is disposed between the heating resistance elements and the protective layer.

However, the insulating layer can be degraded for some reasons, and such an accidental failure can cause electrical communication between the protective layer and a heating resistance element or a wiring line such that electricity flows from the heating resistance element or the wiring line directly to the protective layer. If electricity to be supplied to the heating resistance elements partly flows to the protective layer, an electrochemical reaction can occur between the protective layer and the liquid, thus deteriorating the protective layer. The deterioration of the protective layer may reduce the durability of the protective layer. Furthermore, if different protective layers covering individual heating resistance elements are electrically connected to each other, current may flow to a protective layer different from that in electrical communication with a heating resistance element, expanding the effect of the deterioration in the liquid discharge head.

A configuration in which the individual protective layers are separated from each other is effective in suppressing the above-described effect. However, some liquid discharge heads can have a configuration in which the individual protective layers are not separated, but connected to each other. For example, electrical connection of the protective layers to apply voltage to the protective layers can be used to clean the protective layers in such a manner that an electrochemical reaction is used to dissolve the protective layers into the liquid and thus remove kogation deposited on the protective layers.

Japanese Patent Laid-Open No. 2014-124920 describes a configuration in which a plurality of protective layers are connected through fuses to a common wiring line, which is electrically connected to the protective layers. In this configuration, if the above-described electrical communication occurs and current flows through one of the protective layers, the current can blow the corresponding fuse, causing the protective layer to be electrically disconnected from the other protective layers. This reduces or eliminates the likelihood of expansion of the effect of the deterioration of the protective layer.

As described in Japanese Patent Laid-Open No. 2014-124902, a plurality of individual wiring lines each including the fuse and the common wiring line connected to the individual wiring lines are formed in the same step and, after that, only the fuses are thinned in an additional step. Thinning the fuses increases the ease of blowing the fuses.

SUMMARY

An aspect of the present disclosure provides a liquid-discharge-head substrate including a base including a first heating resistance element and a second heating resistance element that generate heat for liquid discharge, a first covering portion covering the first heating resistance element and having electrical conductivity, a second covering portion covering the second heating resistance element and having electrical conductivity, an insulating layer disposed between the first heating resistance element and the first covering portion and disposed between the second heating resistance element and the second covering portion, a fuse, and a common wiring line for electrically connecting the first covering portion and the second covering portion, the common wiring line electrically connected with the first covering portion via the fuse. The common wiring line and the fuse each have a multilayer structure including a stack of a plurality of conductive layers and the plurality of conductive layers include a first conductive layer and a second conductive layer that is less oxidizable than the first conductive layer.

Further features will become apparent from the following description of exemplary embodiments with reference to the attached drawings.

DESCRIPTION OF THE EMBODIMENTS

Increasing the ease of blowing fuses requires reducing a resistance in a common wiring line to the fuses. The thickness of each fuse can be reduced as described in Japanese Patent Laid-Open No. 2014-124920 for this reason, whereas the thickness of the common wiring line can be increased so that a wiring resistance of the common wiring line is reduced and a large current flows through the fuse. As described in Japanese Patent Laid-Open No. 2014-124920, the additional step of thinning only the fuses involves additional etching. This increases the burden on a manufacturing process.

The present disclosure aims to suppress an increase in burden on a process of manufacturing a liquid-discharge-head substrate and to increase the ease of blowing fuses.

According to the present disclosure, an increase in burden on the process of manufacturing the liquid-discharge-head substrate can be suppressed and the ease of blowing the fuses can be increased.

Exemplary embodiments will be described below with reference to the drawings. The following description is not intended to limit the scope of the present disclosure.

The embodiments relate to an inkjet printing apparatus (hereinafter, also referred to as a "printing apparatus") configured such that a liquid, such as ink, is circulated between a tank and such liquid discharge apparatus. The printing apparatus may have another configuration. For example, the ink is not circulated, two tanks are arranged respectively upstream and downstream of the liquid discharge apparatus, and the ink is allowed to flow from one of the tanks to the other tank, thus causing the ink in a pressure chamber to flow.

The embodiments relate to a line-type head having a length corresponding to the width of a print medium. The present disclosure is also applicable to a serial-type liquid discharge apparatus that performs printing while scanning a head over a print medium. For example, such a serial-type liquid discharge apparatus includes a printing element substrate for black ink and a printing element substrate for each chromatic color ink. The serial-type liquid discharge apparatus may have another configuration. For example, a short line head having a length shorter than the width of a print medium is configured such that discharge port arrays of several printing element substrates are overlapped one another in a direction in which the discharge port arrays are arranged. The head is allowed to scan over a print medium.

Inkjet Printing Apparatus

Figure 10:
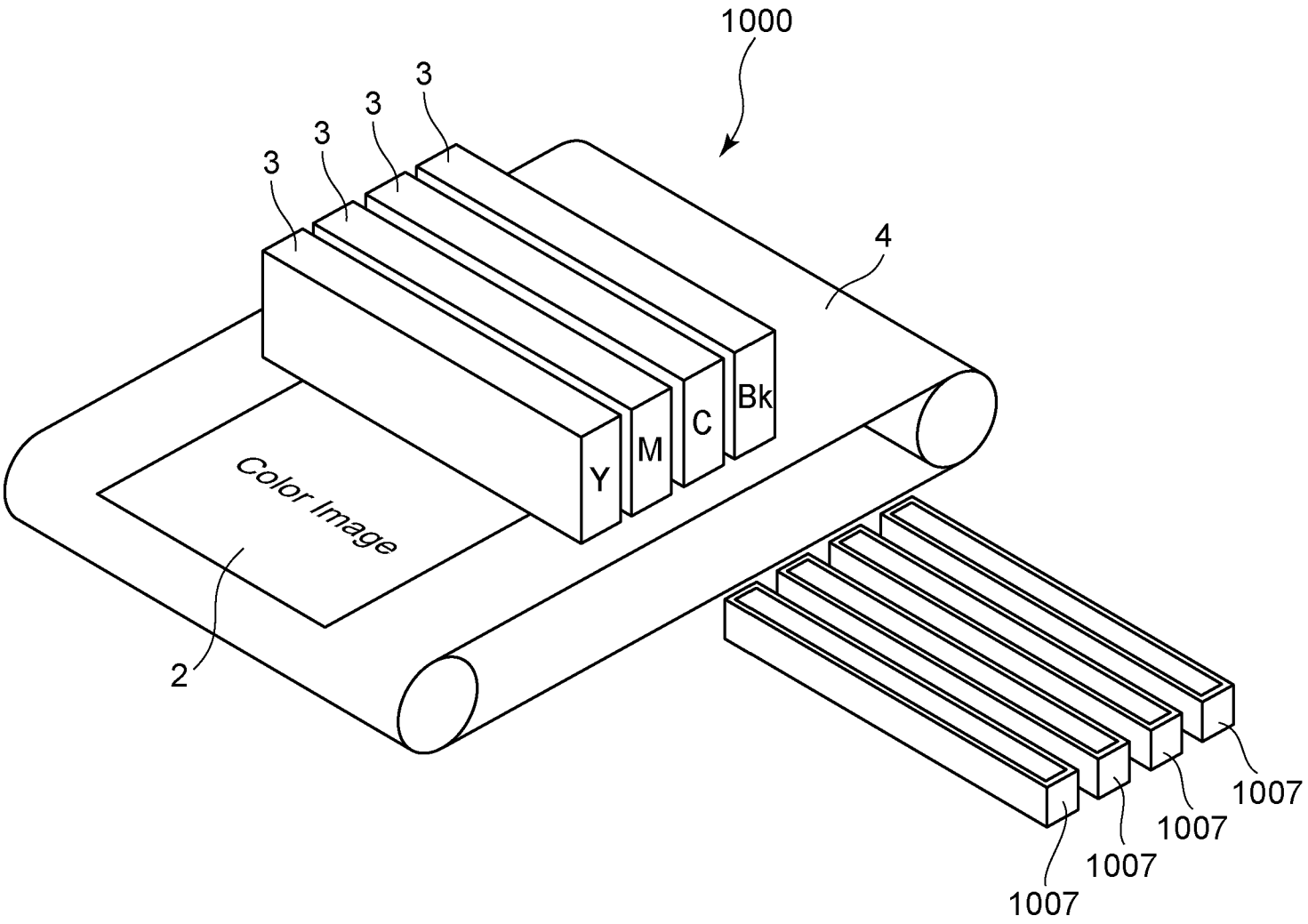
FIG. 10 is a schematic diagram illustrating an exemplary configuration of a printing apparatus.

FIG. 10 illustrates a schematic exemplary configuration of the liquid discharge apparatus in the embodiments, particularly, an inkjet printing apparatus 1000 that performs printing by discharging ink. The printing apparatus 1000 includes a conveying unit 4, that conveys a print medium 2 and line-type liquid discharge head units 3 arranged substantially orthogonal to a conveying direction in which the print medium is conveyed. The printing apparatus 1000 is a line-type printing apparatus that performs continuous printing in one pass while conveying multiple print media 2 continuously or intermittently. The print media 2 are not limited to cut sheets, but may be continuous rolled sheets. The printing apparatus 1000 includes four single-color liquid discharge head units 3 corresponding to four color inks of cyan (C), magenta (M), yellow (Y), and black (Bk). The printing apparatus 1000 further includes caps 1007. During non-printing, each cap 1007 covers a discharge-port surface of the corresponding liquid discharge head unit 3 to prevent the ink from evaporating from discharge ports.

Liquid Discharge Head Unit

Figure 11A:
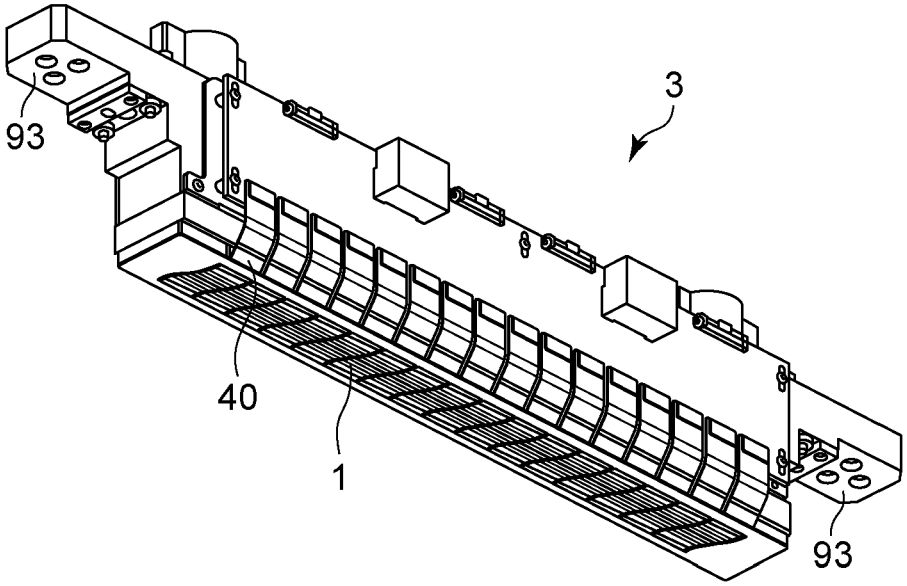
FIGS. 11A and 11B are perspective views of a liquid discharge head unit.
Figure 11B:
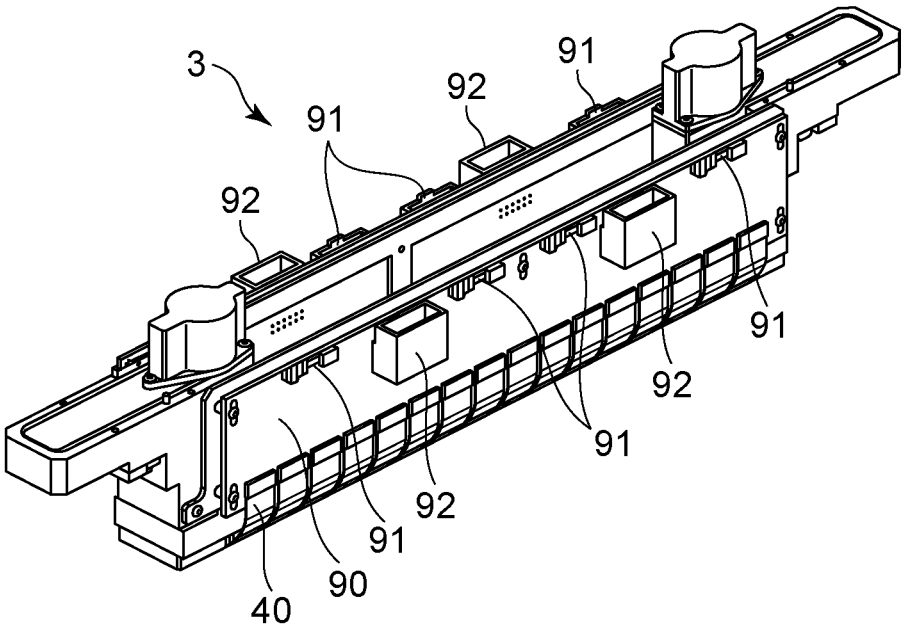

An exemplary configuration of each liquid discharge head unit 3 in the embodiments will now be described. FIGS. 11A and 11B are perspective views of the liquid discharge head unit 3 in the embodiments. The liquid discharge head unit 3 is a line-type liquid discharge head unit including an array of 16 liquid discharge heads 1, which are arranged linearly (in-line arrangement). Each liquid discharge head (printing element substrate) 1 is capable of discharging one color ink. The liquid discharge head units 3 discharging the different color inks have the same configuration.

As illustrated in FIGS. 11A and 11B, the liquid discharge head unit 3 includes the liquid discharge heads 1, flexible wiring substrates 40, and an electric wiring substrate 90 including signal input terminals 91 and power supply terminals 92. The signal input terminals 91 and the power supply terminals 92 are electrically connected to a controller of the printing apparatus 1000. Discharge drive signals and electric power, which are required for discharge, are supplied through the signal input terminals 91 and the power supply terminals 92 to the liquid discharge heads 1. Combining wiring lines through an electric circuit in the electric wiring substrate 90 allows the number of signal input terminals 91 and the number of power supply terminals 92 to be less than the number of liquid discharge heads 1. This leads to a reduction in the number of electrical connection portions to be connected to the printing apparatus 1000 for attachment of the liquid discharge head unit 3 to the printing apparatus or to be disconnected from the printing apparatus 1000 for replacement of the liquid discharge head unit 3. The liquid discharge head unit 3 includes connecting portions 93 arranged on its opposite ends. The connecting portions 93 are connected to an ink supply system of the printing apparatus 1000. The supply system of the printing apparatus 1000 supplies ink to the liquid discharge head unit 3 through one of the connecting portions 93. The ink that has passed through the liquid discharge head unit 3 is collected to the supply system of the printing apparatus 1000 through the other connecting portion 93. As described above, the liquid discharge head unit 3 is configured such that the ink can be circulated through a path in the printing apparatus 1000 and a path in the liquid discharge head unit 3.

First Embodiment

Configuration of Liquid Discharge Head

Figure 1:
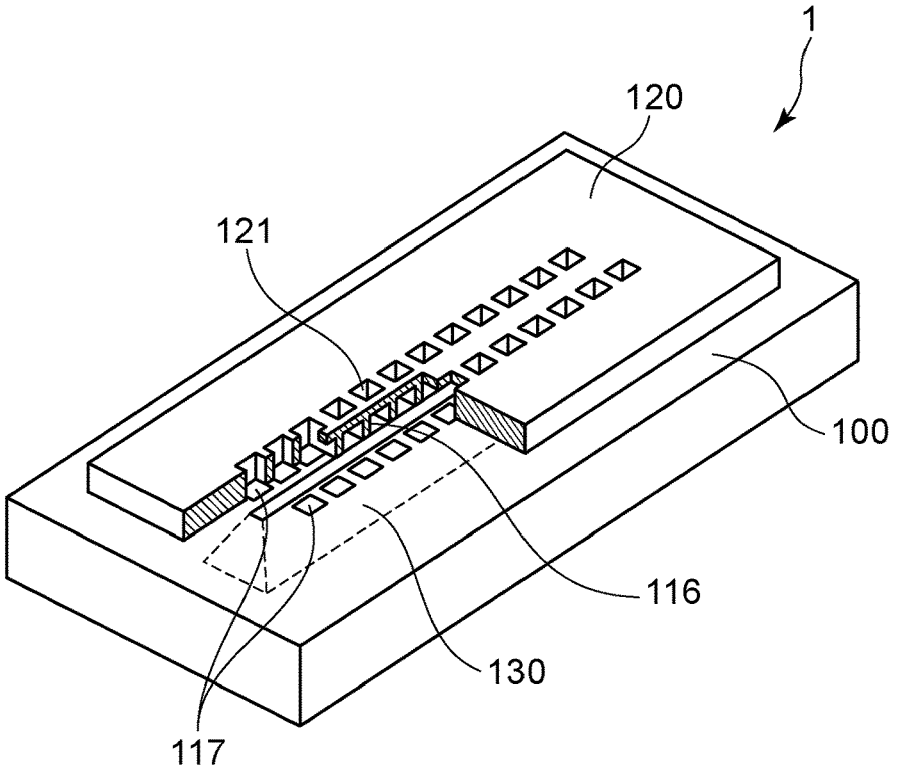
FIG. 1 is a perspective view of a liquid-discharge-head substrate.

FIG. 1 is a schematic perspective view of a liquid discharge head 1 according to a first embodiment. The liquid discharge head 1 according to this embodiment is formed by joining a passage forming member 120 to a liquid-discharge-head substrate 100 (hereinafter, also referred to as a "substrate 100") including heating portions 117 that heat a liquid to be discharged. The passage forming member 120 has discharge ports 121, through which the liquid is discharged, located in correspondence to the respective heating portions 117. The substrate 100 has a supply port 130, through which the liquid is supplied to the heating portions 117, extending through the substrate 100. The substrate 100 and the passage forming member 120, which are joined together, define passages 116 through which the supply port 130 communicates with the discharge ports 121.

Figure 2:
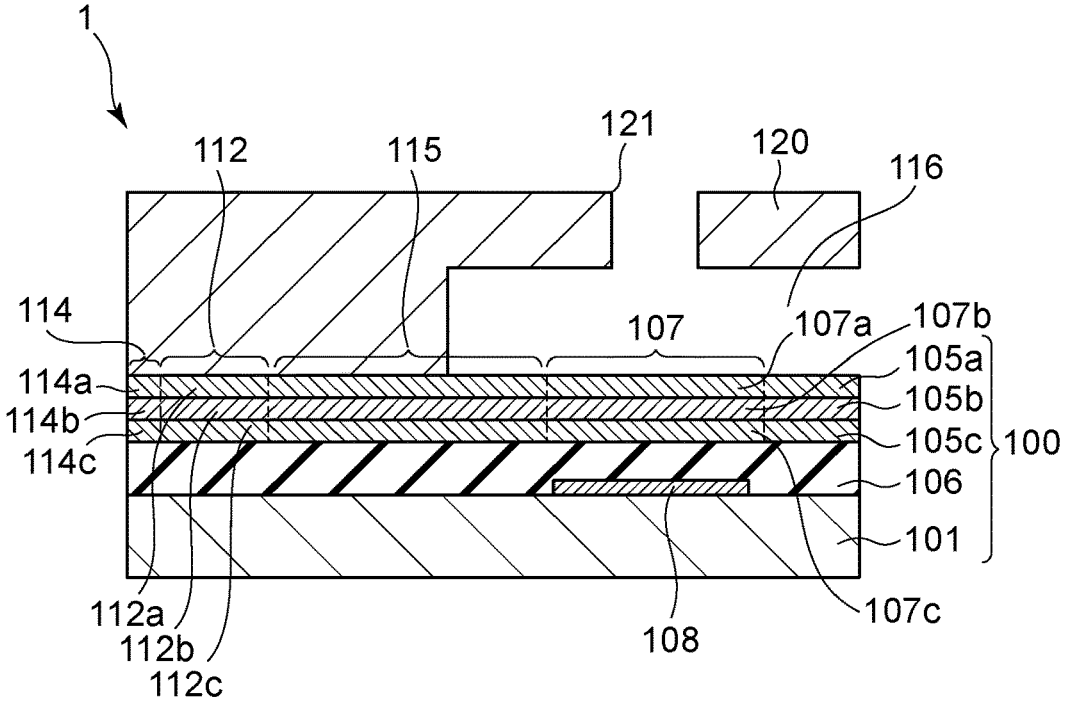
FIG. 2 is a sectional view of part of a liquid discharge head according to a first embodiment.
Figure 3A:
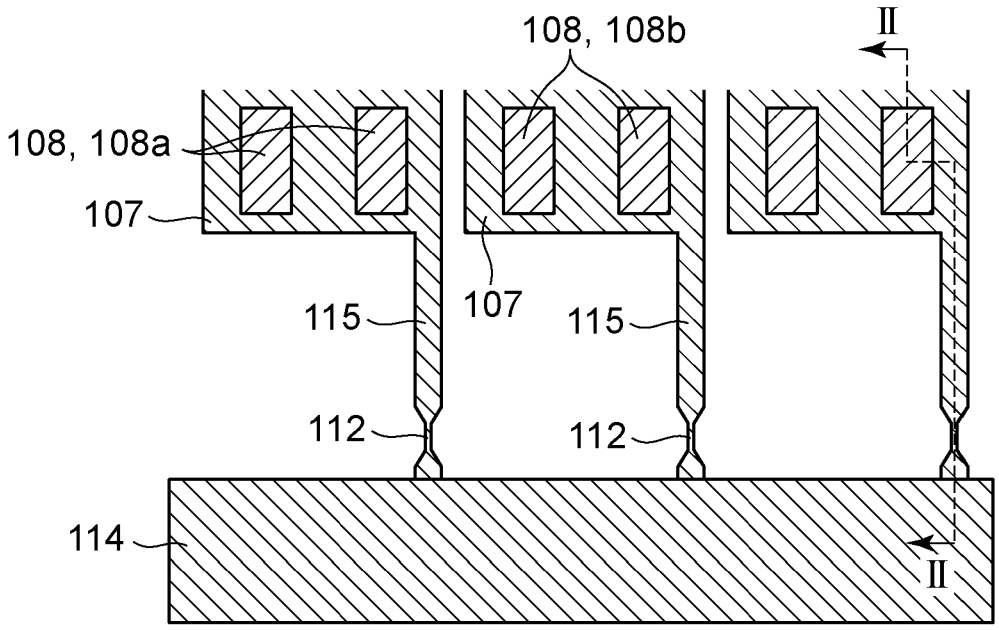
FIG. 3A is a schematic plan view of part of the liquid-discharge-head substrate and the part includes heating resistance elements and fuses.

FIG. 2 is a sectional view of part of the liquid discharge head 1 according to this embodiment, and illustrates a section taken along line II-II in FIG. 3A. FIG. 2 schematically illustrates an exemplary multilayer structure of part of the liquid discharge head 1, and the part includes a heating resistance element 108 and a fuse 112. Although a circuit and wiring lines are not illustrated in FIG. 2, the heating resistance element 108 and the fuse 112 are connected to wiring lines to obtain electric power required for heating or blowing.

The liquid-discharge-head substrate 100 includes a silicon base 101 and the heating resistance element 108 disposed on the base 101. The base 101 includes a heat storage layer of, for example, SiO, disposed on its surface. The heating resistance element 108 for generating thermal energy is formed of, for example, TaSiN. To ensure electrical isolation of the heating resistance element 108, the heating resistance element 108 is covered with an insulating layer 106. The insulating layer 106 is formed of, for example, SiN or SiCN.

To protect the heating resistance element 108 from physical and chemical actions accompanied by heat generated from the heating resistance element, a protective layer 107 is disposed closer to the passage 116 than the heating resistance element 108. The protective layer 107 serves as a covering portion that covers the heating resistance element 108. The protective layer 107 can be formed of a highly chemically resistant elemental metal, such as Ta, Ir, Ru, Ti, W, Nb, or Pt. The protective layer 107 may include a silicon-based (e.g., SiCN or SiCO) film, a metal nitride film, or a carbide film as long as the protective layer 107 has electrical conductivity. In this embodiment, the protective layer 107 includes three sublayers, that is, a third conductive layer 105*c*, a second conductive layer 105*b*, and a first conductive layer 105*a* stacked in that order from a side adjacent to the base 101. In other words, the protective layer 107 has a multilayer structure including a protective sublayer 107*a* constituted by the first conductive layer 105*a*, a protective sublayer 107*b* constituted by the second conductive layer 105*b*, and a protective sublayer 107*c* constituted by the third conductive layer 105*c*. In the following description, the first to third conductive layers 105*a* to 105*c* will also be collectively referred to as "conductive layers 105".

The fuses 112 arranged in the liquid-discharge-head substrate 100 will now be described with reference to FIGS. 3A and 3B. FIG. 3A is a partially see-through plan view schematically illustrating part of the liquid-discharge-head substrate 100 according to this embodiment, and the part includes the heating resistance elements 108 and the fuses 112. To illustrate the positions of the heating resistance elements 108 in FIG. 3A, the heating resistance elements 108 are depicted such that these elements are seen through the protective layers 107. The protective layers 107, serving as a first covering portion and a second covering portion, arranged over first heating resistance elements 108*a* and second heating resistance elements 108*b*, serving as different heating resistance elements 108, are electrically connected to a common wiring line 114 by individual wiring lines 115. The individual wiring lines 115 each include the fuse 112 that generates heat and is thus likely to blow. In this embodiment, two heating resistance elements 108 are covered with one protective layer 107, and the fuse 112 is provided for each protective layer 107. In other words, one fuse 112 is provided for multiple heating resistance elements 108. One heating resistance element 108 may be covered with one protective layer 107, and one fuse 112 may be provided for each heating resistance element 108 (protective layer 107). One fuse 112 may be provided for multiple heating resistance elements 108 as long as the heating resistance elements 108 exhibit good durability.

Figure 3B:
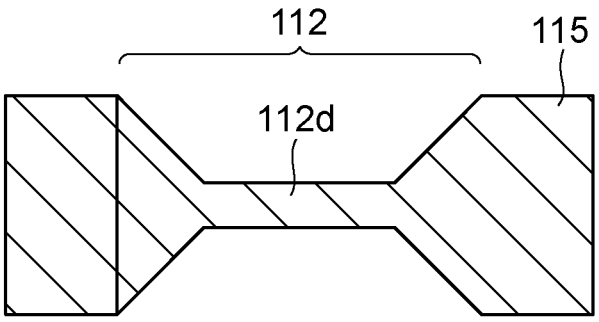
FIG. 3B is a plan view illustrating an exemplary structure of a fuse.

FIG. 3B is a plan view illustrating an exemplary structure of the fuse 112. The fuse 112 includes a narrow portion 112*d*. This portion 112*d* is to blow or be blown (such that electrical disconnection occurs at the portion). Such constricted part in plan view increases a current density, resulting in an increase in amount of heat generation per unit volume. This ensures the ease of blowing the fuse. In this embodiment, for example, the fuse 112 has a length of 10 μm and the narrow portion 112*d* has a width of 2.0 μm.

Figure 4A:
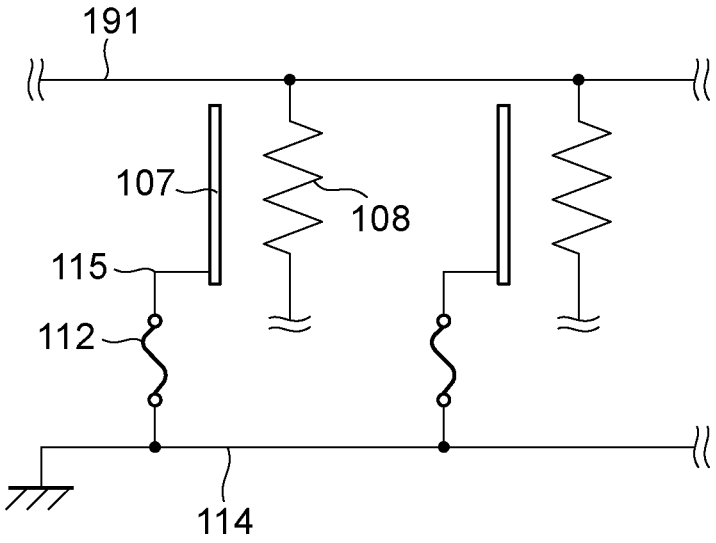
FIGS. 4A and 4B are diagrams illustrating circuits including the heating resistance elements and the fuses of the liquid-discharge-head substrate.
Figure 4B:
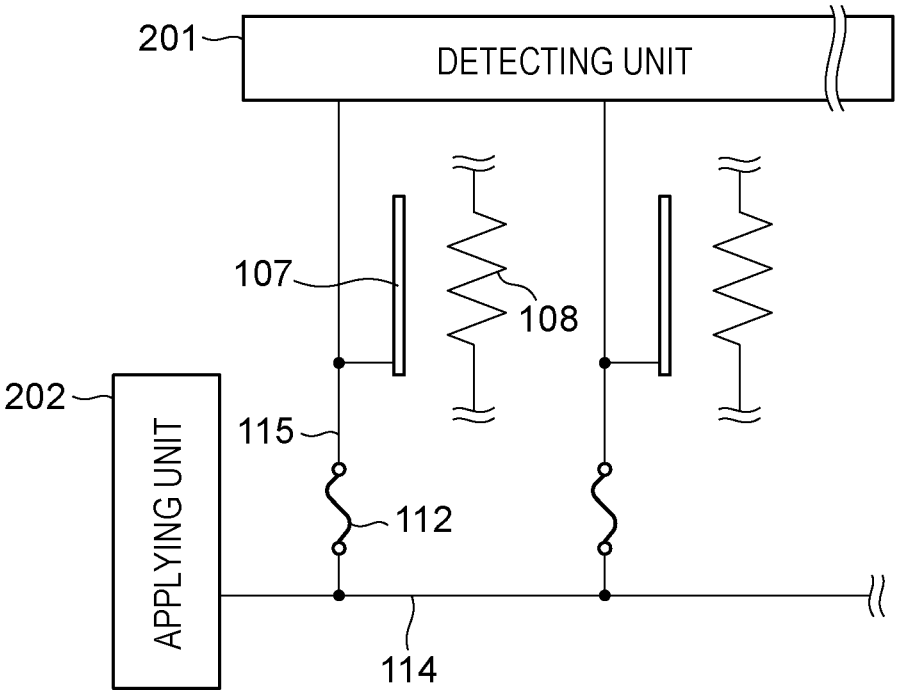

Functions of the fuse 112 will now be described with reference to FIGS. 4A and 4B. FIGS. 4A and 4B are diagrams illustrating circuits including the heating resistance elements 108 and the fuses 112 of the liquid-discharge-head substrate 100.

Referring to FIG. 4A, a power supply potential 191 for driving the heating resistance elements 108 is applied to one end of each heating resistance element 108. The power supply potential 191 is, for example, approximately 20 V to approximately 40 V. A potential of 0 V is continuously applied to one end of each fuse 112 through the common wiring line 114. Consequently, if the insulating layer 106 is degraded and the heating resistance element 108 is brought into electrical communication with the protective layer 107, the protective layer 107 increases in potential due to the effect of the power supply potential 191 and current flows through the fuse 112, causing the fuse 112 to blow. The blowing of the fuse 112 causes the protective layer 107 in electrical communication with the heating resistance element 108 to be electrically separated from the common wiring line 114. This reduces or eliminates the likelihood that the potential may be applied to another protective layer 107 through the common wiring line 114 and the other protective layer 107 may thus be deteriorated.

FIG. 4B illustrates a detecting unit 201 capable of monitoring a potential state of each protective layer 107. When the detecting unit 201 detects a change in potential of any of the protective layers 107 and the potential of the protective layer 107 changes, an applying unit 202 immediately supplies current to the fuse 112 connected to the protective layer 107 in which the change in potential has been detected, thus blowing the fuse 112. Instead of detecting a potential state of each protective layer 107, a temperature measuring element for measuring a temperature in a region in proximity to the heating resistance element 108 may be provided for each heating resistance element 108 and a change in temperature may be detected by using the temperature measuring element. In such a case, whether a discharge condition is normal can be determined based on a detection result indicating whether the temperature has changed. The applying unit 202 can supply current to the fuse 112 corresponding to the heating resistance element 108 that has been determined not to be in the normal discharge condition, thus blowing the fuse 112.

This embodiment will be described based on a configuration as illustrated in FIG. 4A. It is only required that current flows through the fuse 112 to blow the fuse 112 in response to a change in potential of the protective layer 107 in electrical communication with the heating resistance element 108.

A multilayer structure of each fuse 112, each individual wiring line 115, and the common wiring line 114 will now be described with reference to FIG. 2. In this embodiment, to reduce the burden on manufacture, the fuse 112, the individual wiring line 115, and the common wiring line 114 share a common multilayer structure. Each of the fuse 112, the individual wiring line 115, and the common wiring line 114 includes the multiple conductive layers 105 stacked on top of each other. As described above, the conductive layers 105 are three layers. The third conductive layer 105*c*, the second conductive layer 105*b*, and the first conductive layer 105*a* are stacked in that order from the side adjacent to the base 101 in this embodiment. Specifically, the fuse 112 includes a fuse component 112*a* constituted by the conductive layer 105*a*, a fuse component 112*b* constituted by the conductive layer 105*b*, and a fuse component 112*c* constituted by the conductive layer 105*c* such that these components are stacked on top of one another. Furthermore, the common wiring line 114 includes a common wiring line component 114*a* constituted by the conductive layer 105*a*, a common wiring line component 114*b* constituted by the conductive layer 105*b*, and a common wiring line component 114*c* constituted by the conductive layer 105*c* such that these components are stacked on top of one another.

In this embodiment, for example, the conductive layer 105*a* has a thickness of 50 nm and is formed of Ta, the conductive layer 105*b* has a thickness of 50 nm and is formed of Ir, and the conductive layer 105*c* has a thickness of 50 nm and is formed of Ta. These conductive layers 105*a* to 105*c* are also shared by the above-described protective layer 107. In other words, the fuse 112, the individual wiring line 115, and the common wiring line 114 share the common multilayer structure, and the protective layer 107 also shares the common multilayer structure. Although the fuse 112 and the protective layer 107 may have different multilayer structures in terms of, for example, materials for the layers or the number of layers, the fuse 112 and the protective layer 107 may share at least one of the components of the multilayer structure in order to reduce the burden on the manufacturing process.

In this embodiment, at least one of the multiple conductive layers 105 included in the fuse 112 is less oxidizable than the other conductive layers 105. Specifically, the conductive layer 105*b* is formed of Ir, which is less oxidizable than Ta forming the conductive layers 105*a* and 105*c*.

As used herein, the term "less oxidizable" means that a temperature at which the rate of oxidation suddenly increases at a constant oxygen concentration under a constant pressure is relatively high. In the following description, this temperature will be referred to as an "oxidation temperature".

Figure 5:
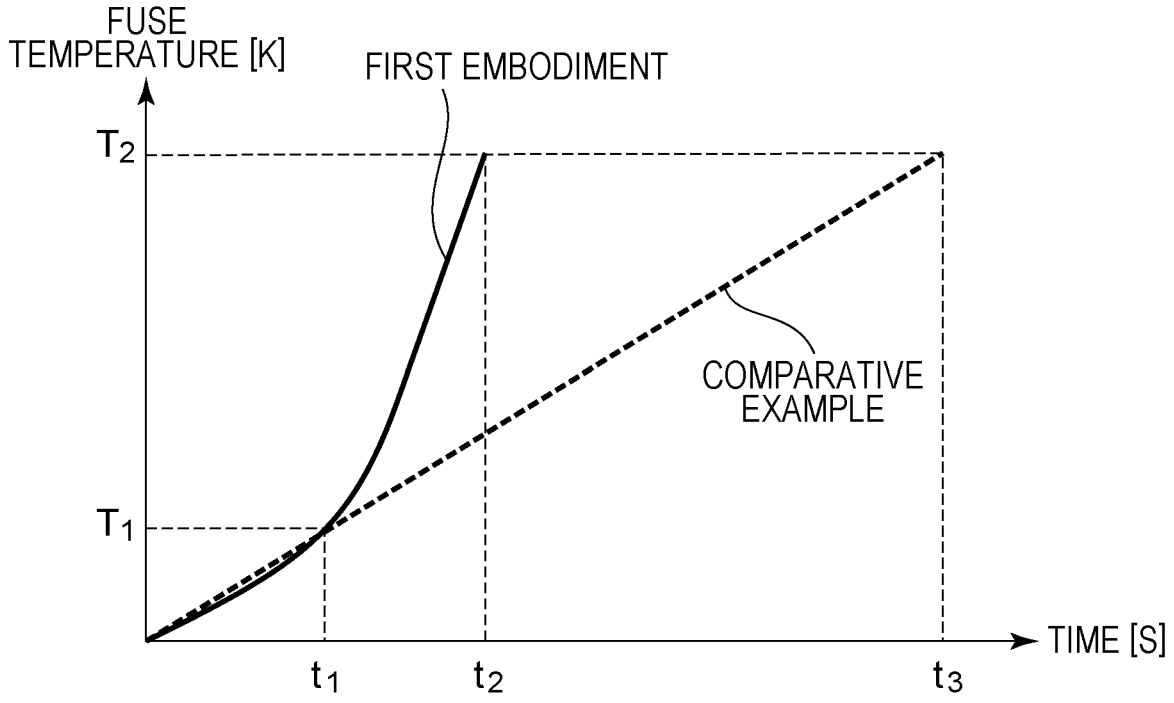
FIG. 5 is a graph illustrating changes in temperature of fuses before blowing of the fuses.

A change in temperature before blowing of the fuse 112 including the multiple conductive layers 105 stacked on top of one another in this embodiment will be described with reference to FIG. 5. FIG. 5 illustrates a change in temperature of the fuse 112 in this embodiment and a change in temperature of a fuse in Comparative Example. The fuse in Comparative Example is constituted by a single conductive layer 105 of Ir. In FIG. 5, a full line represents a change in temperature of the fuse 112 in this embodiment and a broken line represents a change in temperature of the fuse in Comparative Example. The fuse in Comparative Example has a thickness equal to the sum of the thicknesses of the multiple layers included in the fuse 112 in this embodiment.

For the fuse constituted by the single Ir layer in Comparative Example, the amount of heat generation per unit volume per unit time is constant during the period from the time when current flows through the fuse to start heat generation to the time when the fuse is blown. At time $t_3$, the temperature of the fuse reaches the melting point (approximately 2500° C.), indicated at $T_2$, of Ir and the fuse is blown.

For the fuse 112 having the multilayer structure in this embodiment, current flows through the fuse 112 to start heat generation and, after that, the temperature of the fuse 112 reaches an oxidation temperature (e.g., approximately 600° C. in this embodiment), indicated at $T_1$, of Ta. Consequently, the oxidation of Ta suddenly accelerates, thus causing Ta, which has an electric resistivity of 131 nΩ·m, to become an insulator. Thus, the current hardly flows through the fuse components 112*a* and 112*c*, serving as the conductive layers 105*a* and 105*c* formed of Ta. The current concentrates in the fuse component 112*b*, serving as the conductive layer 105*b* formed of Ir having an electric resistivity of 47 nΩ·m. The current concentration increases the amount of heat generation per unit volume of the fuse 112 because an effective thickness, through which the current flows, of the fuse 112 having a thickness of 150 nm, which is the total thickness of the three layers, is reduced to 50 nm corresponding to the thickness of the conductive layer 105*b*. In other words, the temperature of the fuse 112 suddenly rises after time $t_1$ at which the temperature of the fuse 112 has reached $T_1$. After that, at time $t_2$, the temperature of the fuse 112 reaches the melting point $T_2$ of Ir, so that the fuse component 112*b* blows. This blowing affects the fuse components 112*a* and 112*c*, so that these fuse components also blow. This results in blowing of the fuse 112 including the multiple conductive layers 105 stacked on top of one another. Therefore, the time that has elapsed before the blowing of the fuse 112, which includes the oxidizable layers and the less oxidizable layer, in this embodiment is shorter than the time that has elapsed before the blowing of the fuse in Comparative Example.

If the fuse components 112*a* and 112*c*, respectively constituted by the oxidizable conductive layers 105*a* and 105*c*, fail to fully become an insulator and are partially oxidized before blowing of the fuse 112, the above-described advantages can be obtained. Specifically, partial oxidation of the fuse components 112*a* and 112*c* results in an increase in current flowing through the fuse component 112*b*, which is less oxidizable, thus increasing the amount of heat generation from the fuse component 112*b*. This facilitates blowing of the fuse 112. However, if the fuse components 112*a* and 112*c* are too thick, the proportion of part to be oxidized may be reduced. Unfortunately, the effects of increased ease of blowing the fuse 112 may be reduced. To fully obtain the effects of increased ease of blowing, the oxidizable conductive layers 105*a* and 105*c* may have a thickness ranging between approximately 10 nm and approximately 800 nm.

As described above, according to this embodiment, the common wiring line 114 is thick enough to reduce its wiring resistance, and some of the layers included in the fuse 112 can be oxidized to reduce the effective thickness of the fuse and increase the ease of blowing the fuse.

The materials for the multiple conductive layers 105 constituting the fuse 112 will now be described. The less oxidizable conductive layer, or the second conductive layer 105*b* in this embodiment, may be formed of a conductive material that is less oxidizable than a material for the other conductive layers, or the first and third conductive layers 105*a* and 105*c* in this embodiment. As the material forming the less oxidizable conductive layer, a platinum-group metal, such as Ru, Rh, Pd, Os, Ir, or Pt, can be used. As the material forming the oxidizable conductive layer, a conductive material other than platinum-group metals may be used. Examples of suitable conductive materials include metals, such as Ta, Al, Ti, Cr, Mn, Fe, Co, Ni, and W, alloys containing such metals, nonmetals, such as Si and C, and organic and inorganic materials containing such nonmetals.

The melting point of the less oxidizable conductive layer 105*b* is higher than the oxidation temperature of the oxidizable conductive layers 105*a* and 105*c*. To concentrate current in the less oxidizable conductive layer 105*b* after oxidation of the oxidizable conductive layers 105*a* and 105*c*, the electric resistance of the less oxidizable conductive layer 105*b* is lower than that of the oxidized conductive layers 105*a* and 105*c*.

The fuse 112 may be made thinner to increase the ease of blowing the fuse 112. The protective layer 107 may be made thicker to improve the durability of the protective layer 107. If the fuse 112 and the protective layer 107 share the common multilayer structure, the overall thickness of the fuse 112 and that of the protective layer 107 may range between 10 nm and 1.0 μm.

An exemplary stacking order of the layers included in the fuse 112 will now be described. As described in this embodiment, the conductive layer 105*a* adjacent to the passage forming member 120 is formed of Ta, which is more oxidizable than Ir. This arrangement promotes a reaction between the conductive layer 105*a* and oxygen contained in the passage forming member 120, thus promoting oxidation of the conductive layer 105*a*. Therefore, the conductive layer 105*a* adjacent to the passage forming member 120 may be formed of a material that is more oxidizable than the conductive layer 105*b*. Furthermore, the conductive layer 105*c* adjacent to the base 101 is formed of Ta, which is more oxidizable than Ir. This arrangement facilitates incorporation of oxygen contained in the insulating layer 106 and the base 101 into the third conductive layer 105*c*, thus promoting oxidation of the third conductive layer 105*c*. Therefore, the third conductive layer 105*c* adjacent to the base 101 may be formed of a material that is more oxidizable than the material of the conductive layer 105*b*. Furthermore, each oxidizable conductive layer 105 may be in contact with an oxygen-containing layer, such as the passage forming member 120 or the insulating layer 106. In this arrangement, heat generation of the fuse 112 causes oxygen in the oxygen-containing layer to be incorporated into the oxidizable conductive layer 105 included in the fuse 112, thus promoting oxidation of the conductive layer 105. Examples of the oxygen-containing layer include a layer of an organic material, which is used to form the passage forming member 120, a layer of SiN or SiCN, which is used to form the insulating layer 106, and a layer of SiO, which is disposed on the surface of the base 101.

The materials, thicknesses, and stacking order of the conductive layers 105 are not limited to those described above. As described above, it is only required that the fuse 112 includes a conductive layer formed of a relatively oxidizable material and a conductive layer formed of a relatively less oxidizable material to increase the ease of blowing the fuse 112.

Method for Manufacturing Liquid Discharge Head

Figure 6A:
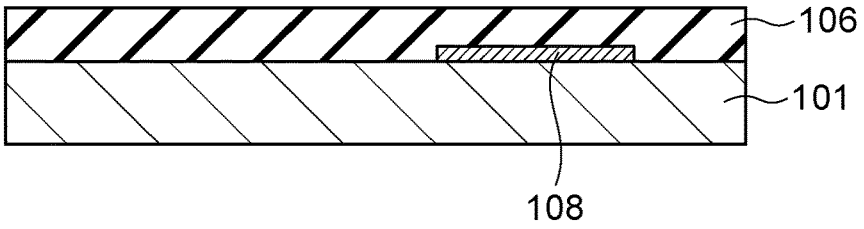
FIGS. 6A to 6C are sectional views illustrating a method for manufacturing the liquid discharge head according to the first embodiment.
Figure 6B:
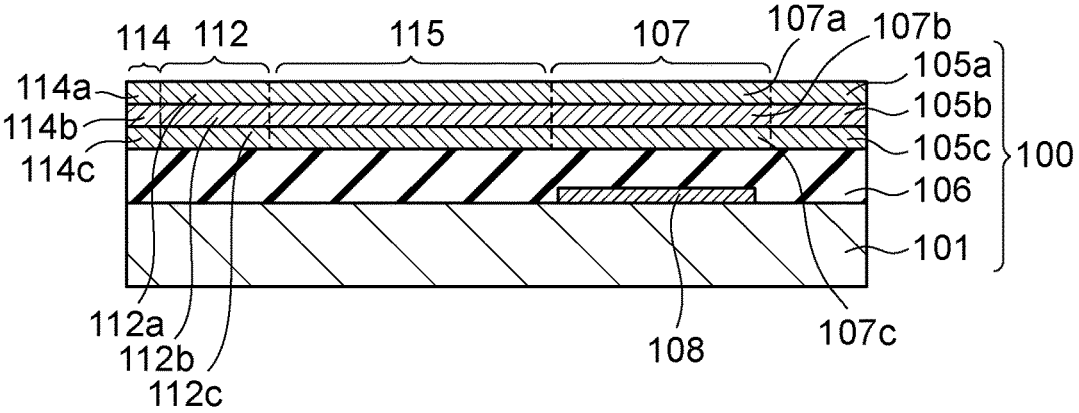
Figure 6C:
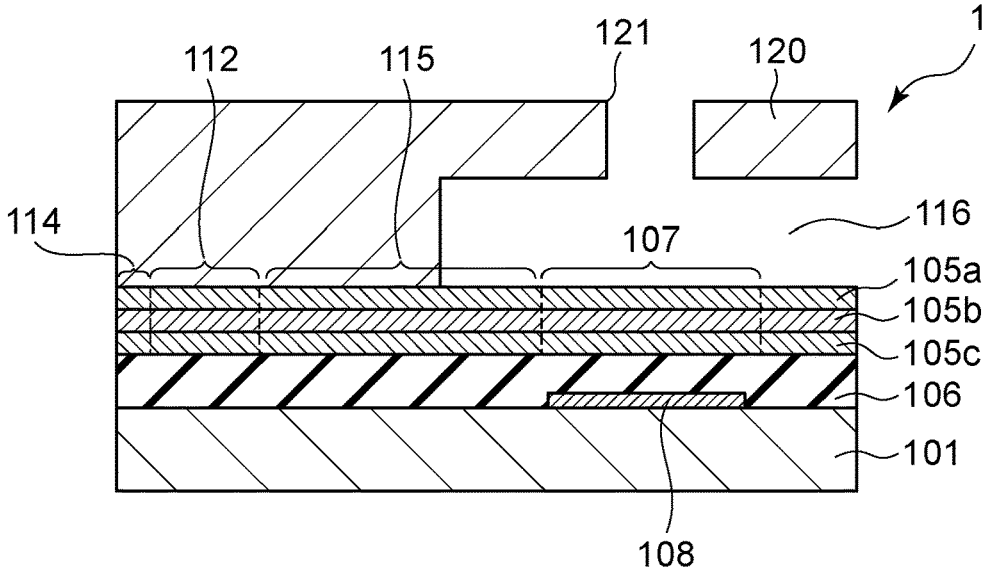

A method for manufacturing the liquid discharge head 1 according to this embodiment will now be described. FIGS. 6A to 6C are sectional views schematically illustrating the method for manufacturing the liquid discharge head 1 according to this embodiment.

FIG. 6A illustrates a state in which the insulating layer 106 having a thickness of 150 nm is formed on the base 101 with the heating resistance element 108 by chemical vapor deposition (CVD). In this embodiment, each of the fuses 112, the individual wiring lines 115, the common wiring line 114, and the protective layers 107, which are to be formed in a subsequent step, is provided with an underlying layer, which is the insulating layer 106. The insulating layer 106, serving as an underlying layer for these lines and layers, may be partly removed as long as the heating resistance elements 108 can function properly.

Subsequently, as illustrated in FIG. 6B, the three conductive layers 105*a* to 105*c* constituting the fuses 112, the individual wiring lines 115, the common wiring line 114, and the protective layers 107 covering the heating resistance elements 108 are formed by sputtering. In this embodiment, as described above, the first and third conductive layers 105*a* and 105*c* are formed of Ta and the second conductive layer 105*b* is formed of Ir. The conductive layers 105*a* to 105*c* have the same thickness, 50 nm. The three conductive layers 105 are simultaneously subjected to dry etching, thus forming the fuses 112, the individual wiring lines 115, the common wiring line 114, and the protective layers 107 into planar shapes as illustrated in FIG. 3A. Since the fuses 112, the individual wiring lines 115, the common wiring line 114, and the protective layers 107 have the same multilayer structure, the step of forming the conductive layers 105 and the step of etching the layers to form the layers into intended planar shapes can be common steps.

After that, as illustrated in FIG. 6C, the passage forming member 120 for forming the passages 116 to supply the liquid to the heating portions 117 corresponding to the heating resistance elements 108 is disposed on the liquid-discharge-head substrate 100. The passage forming member 120 is joined to the liquid-discharge-head substrate 100, thus defining the passages 116 therebetween. The passage forming member 120 may be made of an organic material, an inorganic material, or a combination of such materials. For example, a layer of a photosensitive organic material is formed at a thickness of 5.0 μm by spin coating and is exposed to light by photolithography. Then, a layer of another photosensitive organic material is formed at a thickness of 5.0 μm by spin coating and is exposed to light by photolithography. After that, the two layers of these two photosensitive organic materials are simultaneously developed and thermally cured, thus forming the passage forming member 120 having passages.

In this embodiment, as described above, the fuses 112 and the common wiring line 114 share the common multilayer structure. Therefore, the fuses 112 and the common wiring line 114 can be formed in the common steps, in which the multiple conductive layers 105 are formed by sputtering and are then simultaneously patterned by etching. Consequently, an increase in burden on the manufacturing process is suppressed, and the fuses 112 with the above-described increased ease of blowing are provided.

It is only required that the common wiring line 114 includes at least one component (the conductive layers 105*a* to 105*c* in this embodiment) of the common multilayer structure shared by the fuses 112. Specifically, for example, the common wiring line 114 may be electrically connected to another conductive layer to reduce the wiring resistance of the common wiring line 114 as long as this electrical connection involves no process of correcting a mask pattern.

Second Embodiment

The following description will focus on the difference between the first embodiment and a second embodiment.

Configuration of Liquid Discharge Head

Figure 7A:
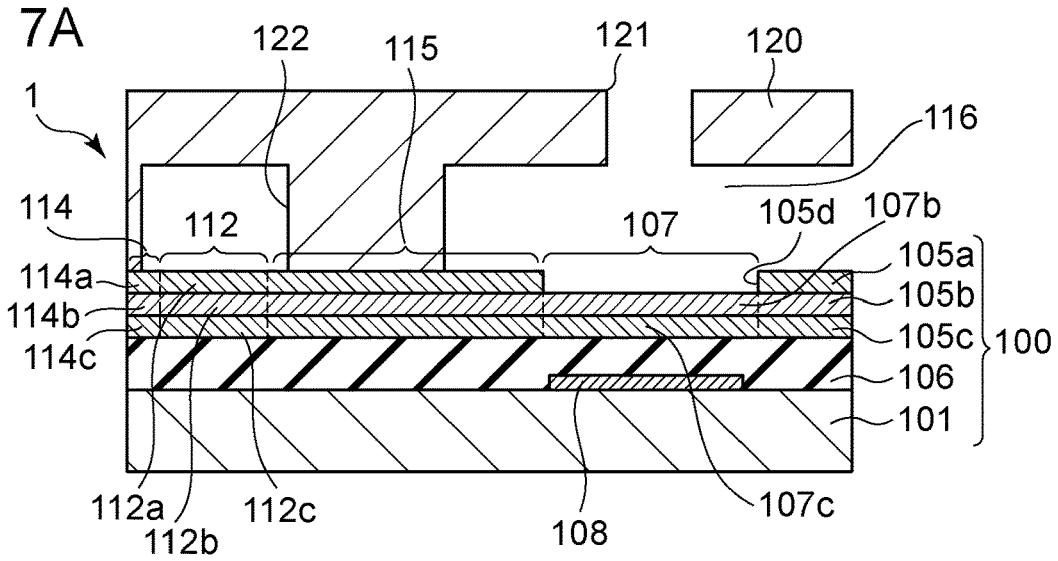
FIGS. 7A to 7C are sectional views of parts of liquid discharge heads according to a second embodiment and modifications of the second embodiment.

FIG. 7A is a sectional view of part of a liquid discharge head 1 according to the second embodiment. FIG. 7A schematically illustrates an exemplary multilayer structure of part of the liquid discharge head 1, and the part includes a heating resistance element 108 and a fuse 112. Although a circuit and wiring lines are not illustrated in FIGS. 7A to 7C, the heating resistance element 108 and the fuse 112 are connected to wiring lines to obtain electric power required for heating or blowing.

The liquid discharge head 1 according to the second embodiment has substantially the same fundamental configuration as that in the above-described first embodiment. Specifically, as in the first embodiment, the fuse 112 in the second embodiment includes a fuse component 112*a* constituted by a conductive layer 105*a*, a fuse component 112*b* constituted by a conductive layer 105*b*, and a fuse component 112*c* constituted by a conductive layer 105*c* such that these components are stacked on top of one another. Furthermore, a common wiring line 114 includes a common wiring line component 114*a* constituted by the conductive layer 105*a*, a common wiring line component 114*b* constituted by the conductive layer 105*b*, and a common wiring line component 114*c* constituted by the conductive layer 105*c* such that these components are stacked on top of one another. In other words, the common wiring line 114 includes at least the multilayer structure of the fuse 112.

However, a protective layer 107 over the heating resistance element 108 differs from that in the first embodiment. Part of the conductive layer 105*a* is removed over the heating resistance element 108. The conductive layers 105*b* and 105*c*, or two layers, constitute the protective layer 107 over the heating resistance element 108. In other words, the protective layer 107 includes a protective sublayer 107*b* constituted by the conductive layer 105*b* and a protective sublayer 107*c* constituted by the conductive layer 105*c* such that these sublayers are stacked on top of each other. The conductive layer 105*b* formed of Ir, which is less likely to chemically react with liquid than Ta forming the conductive layer 105*c*, is exposed in a passage 116. This arrangement allows the protective layer 107 to exhibit higher resistance to liquid than that in the first embodiment, thus improving the durability of the heating resistance element 108.

Unlike the passage forming member 120 in the first embodiment, a passage forming member 120 in the second embodiment has a recess 122 aligned with each fuse 112 in a direction in which the conductive layers are stacked on top of each other. In the recess 122, the fuse component 112*a* is in contact with air. In other words, the recess 122 overlaps with at least a part of the fuse 112 when viewed in a direction orthogonal to the surface of a base 101. The recess 122 opens to, or faces the fuse 112.

Figure 8:
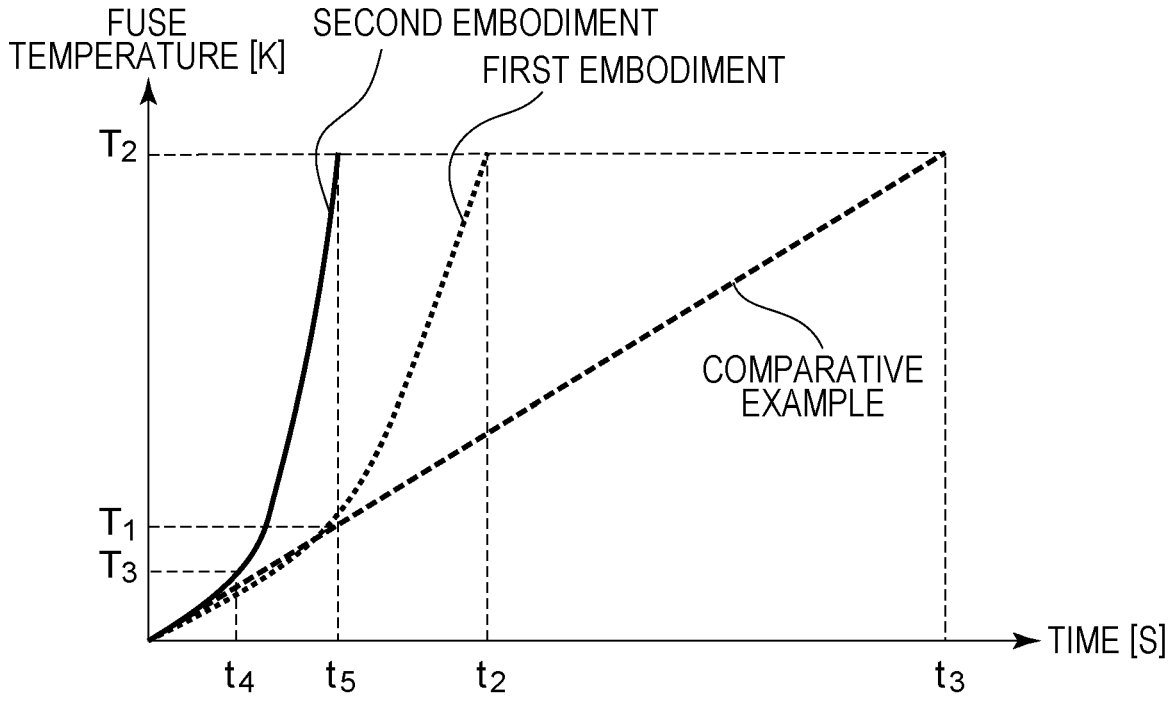
FIG. 8 is a graph illustrating changes in temperature of fuses before blowing of the fuses.

FIG. 8 illustrates a change in temperature of the fuse 112 of the liquid discharge head 1 according to the second embodiment, a change in temperature of the fuse 112 of the liquid discharge head 1 according to the first embodiment, and a change in temperature of the fuse constituted by the single conductive layer 105 of Ir in Comparative Example. A full line represents the change in temperature of the fuse 112 in the second embodiment and two broken lines represent the change in temperature of the fuse 112 in the first embodiment and that of the fuse in Comparative Example.

In the second embodiment, current flowing through the fuse 112 causes oxidation of the fuse components 112*a* and 112*c* formed of Ta, which is an oxidizable material, as in the first embodiment. Consequently, the current concentrates in the fuse component 112*b* formed of Ir, which is a less oxidizable material, thus increasing the ease of blowing the fuse 112.

In the second embodiment, part of the passage forming member 120 is removed over the fuse 112, thus reducing heat dissipation from the fuse 112 to the passage forming member 120. Consequently, the temperature of the fuse 112 tends to rise. In addition, the contact between the fuse component 112*a* formed of Ta, which is an oxidizable material, and the air further promotes oxidation of the fuse component 112*a*. In other words, an oxidation temperature $T_3$ in the second embodiment is lower than the oxidation temperature $T_1$ in the first embodiment. Consequently, time $t_4$ at which the current starts to concentrate in the fuse component 112*b* constituted by the conductive layer 105*b* formed of Ir is earlier than time $t_1$ in the first embodiment. Therefore, the amount of heat generation per unit volume of the fuse component 112*b* starts earlier to increase. Thus, the fuse 112 in the second embodiment melts and blows at time $t_5$, which is earlier than time $t_2$ at which the fuse blows in the first embodiment.

Figure 7B:
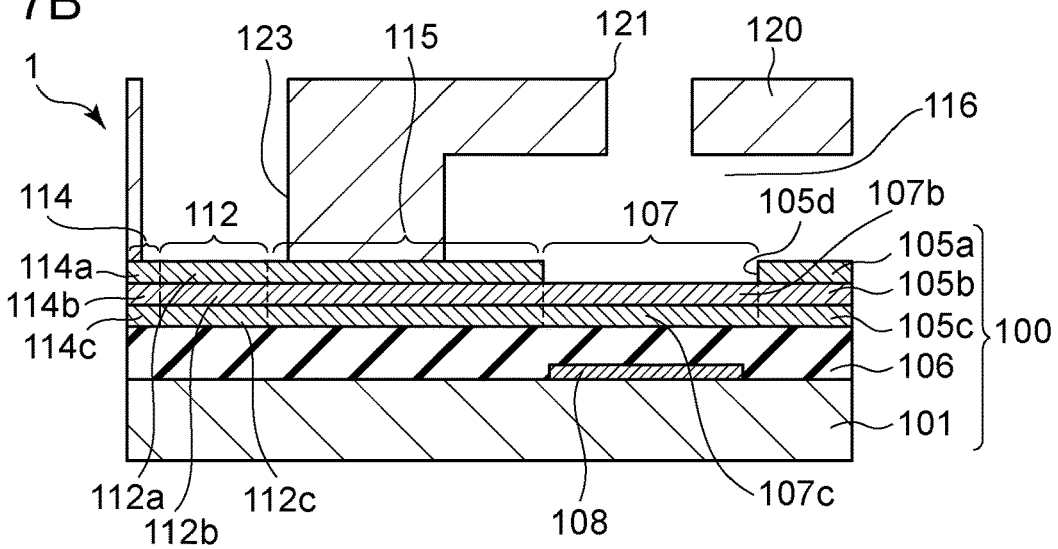
Figure 7C:
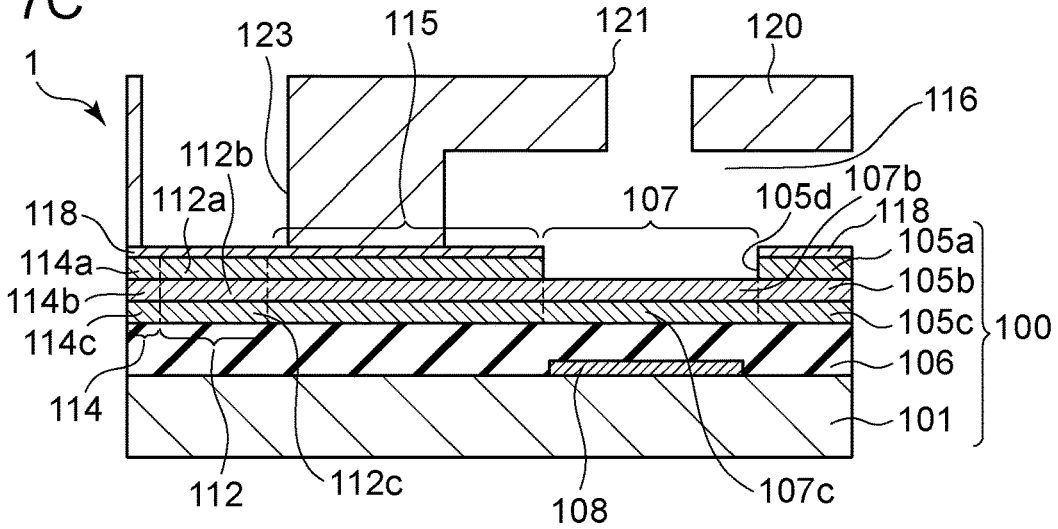

FIGS. 7B and 7C are sectional views illustrating modifications of the second embodiment. As illustrated in FIG. 7B, the passage forming member 120 may have a through-hole 123 instead of the recess 122 such that part of the passage forming member 120 is removed over the fuse component 112*a*.

As illustrated in FIG. 7C, a coating 118 (a coating film) may be disposed to protect the fuse 112 from the liquid. The coating 118 may be formed of a material that contains Si and C, such as SiC or SiCN, which is hardly corroded by liquid or highly resistant to liquid, and may cover the fuse 112. In particular, if the passage forming member 120 has a through-hole 123 disposed in a discharge-port surface having discharge ports 121, the liquid may pass through the through-hole 123 in the discharge-port surface and contact the fuse 112. For this reason, such a coating 118 can be disposed. The coating 118 has a thickness of, for example, approximately 150 nm. The passage forming member 120 has a thickness of, for example, approximately several tens of micrometers. In this arrangement in which the thin coating 118 is disposed on the fuse 112, part of the passage forming member 120, which is thicker than the coating 118, is removed over the fuse 112, thus reducing heat dissipation from the fuse 112. This facilitates increase in temperature of the fuse 112, thus making the fuse 112 easier to blow.

It is only required that each of the recess 122 in FIG. 7A and the through-holes in FIGS. 7B and 7C overlaps the fuse 112 when viewed in the direction orthogonal to the surface of the base 101. As illustrated in FIG. 7A, the recess 122 may be disposed such that the whole of the fuse 112 is located within the recess 122 when viewed in the direction orthogonal to the surface of the base 101. Furthermore, as illustrated in FIGS. 7B and 7C, the through-hole 123 may be disposed such that the whole of the fuse 112 is located within the through-hole 123 when viewed in the direction orthogonal to the surface of the base 101. Such arrangement increases the effect of heat dissipation from the fuse 112, thus increasing the ease of blowing the fuse 112.

Method for Manufacturing Liquid Discharge Head

A method for manufacturing the liquid discharge head 1 according to this embodiment will now be described. FIGS. 9A to 9D are schematic sectional views illustrating the method for manufacturing the liquid discharge head according to this embodiment.

Figure 9A:
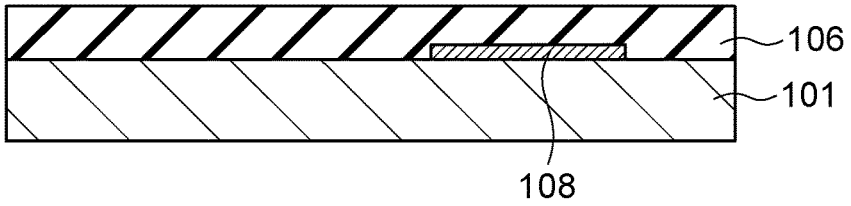
FIGS. 9A to 9D are sectional views illustrating a method for manufacturing the liquid discharge head according to the second embodiment.
Figure 9B:
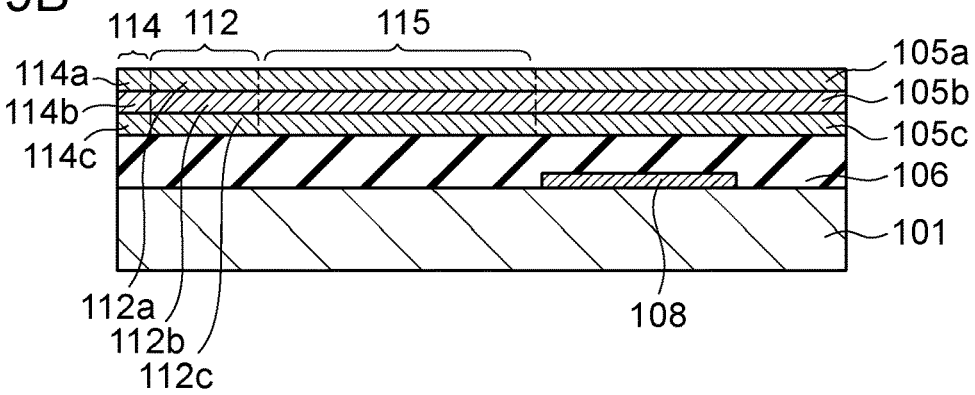

FIGS. 9A and 9B illustrate the same steps as those in FIGS. 6A and 6B, respectively.

Figure 9C:
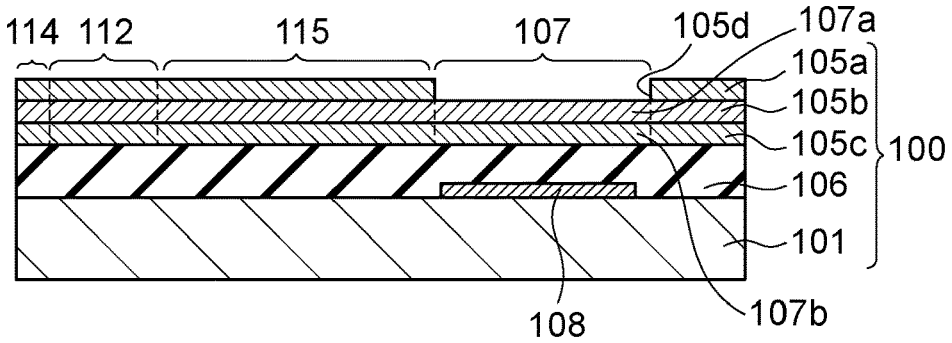

Then, photolithography is used. As illustrated in FIG. 9C, the part of the conductive layer 105*a*, formed of Ta, over the heating resistance element 108 is removed by dry etching, thus forming an opening 105*d* in the conductive layer 105*a*. Consequently, the protective layer 107 covering the heating resistance element 108 is composed of two conductive layers 105, or the conductive layers 105*b* and 105*c*. Furthermore, the conductive layer 105*b*, formed of Ir, included in the protective layer 107 is exposed in the opening 105*d* so that the conductive layer 105*b* can face the passage 116.

Figure 9D:
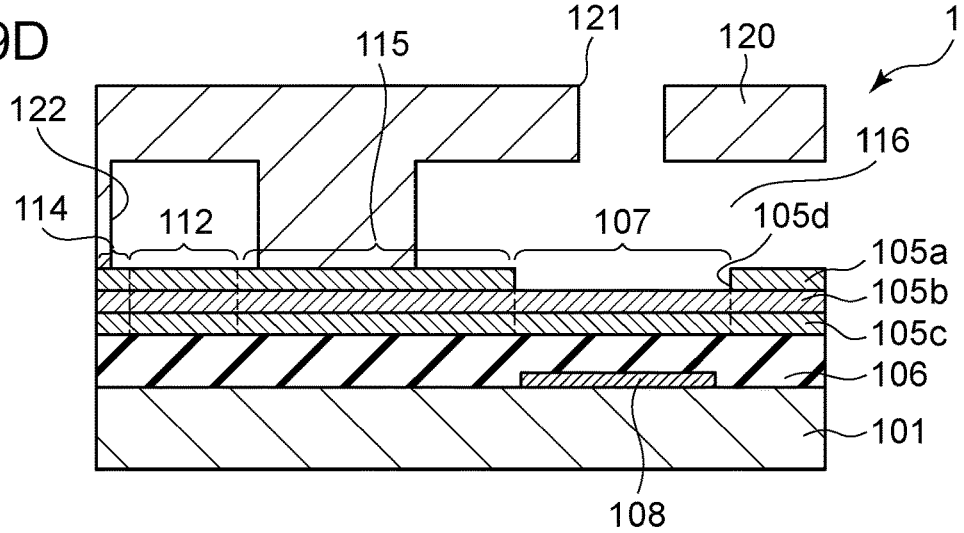

After that, as illustrated in FIG. 9D, the passage forming member 120 for forming the passages 116 to supply the liquid to the heating portions 117 corresponding to the heating resistance elements 108 is disposed on the liquid-discharge-head substrate 100. Although this step is fundamentally the same as that in the first embodiment, the passage forming member 120 has the recesses 122 in the second embodiment. The recesses 122 can also be formed in the step of forming the passages 116, thus reducing the burden on manufacture.

Instead of partly removing the conductive layer 105*a* in the step of FIG. 9C, two conductive layers 105 other than the conductive layer 105*a*, or the conductive layers 105*b* and 105*c*, may be formed in the step of FIG. 9B. In other words, for example, the fuses 112 and the common wiring line 114 other than the protective layers 107 may have a two-layer structure, or may be composed of the conductive layers 105*b* and 105*c*. However, since the passage forming member 120 is partly removed on the fuses 112, an oxidizable layer of, for example, Ta, disposed adjacent to the passage forming member 120 can facilitate oxidation of the fuses 112. Therefore, disposing the conductive layer 105*a* adjacent to the passage forming member 120 and allowing the conductive layer 105*a* to serve as the fuse component 112*a* further increase the ease of blowing the fuses 112. In this embodiment, therefore, each fuse 112 has a three-layer structure, or includes the fuse component 112*a* constituted by the conductive layer 105*a* of Ta, the fuse component 112*b* constituted by the conductive layer 105*b* of Ir, and the fuse component 112*c* constituted by the conductive layer 105*c* of Ta stacked in that order from the side adjacent to the passage 116. To increase the resistance to liquid of the protective layer 107 as described above, the protective layer 107 has the two-layer structure, or includes the conductive layer 105*b* of Ir and the conductive layer 105*c* of Ta stacked in that order from the side adjacent to the passage 116.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-030193, filed Feb. 22, 2018, and No. 2019-003804, filed Jan. 11, 2019, which are hereby incorporated by reference herein in their entirety.

What is claimed is:

1. A liquid-discharge-head substrate comprising:

a base including a first heating resistance element and a second heating resistance element that generate heat for liquid discharge;

a first covering portion covering the first heating resistance element and having electrical conductivity;

a second covering portion covering the second heating resistance element and having electrical conductivity;

an insulating layer disposed between the first heating resistance element and the first covering portion and disposed between the second heating resistance element and the second covering portion;

a fuse; and a common wiring line for electrically connecting the first covering portion and the second covering portion, the common wiring line electrically connected with the first covering portion via the fuse, wherein the common wiring line and the fuse each have a multilayer structure including a stack of a plurality of conductive layers and the plurality of conductive layers include a first conducive layer and a second conductive layer that is less oxidizable than the first conductive layer.

2. The liquid-discharge-head substrate according to claim 1, wherein the second conductive layer has an electric resistance lower than that of the first conductive layer oxidized.

3. The liquid-discharge-head substrate according to claim 1, wherein the first covering portion includes at least either the first conductive layer or the second conductive layer.

4. The liquid-discharge-head substrate according to claim 1, wherein the first conductive layer comprises a conductive material other than platinum-group metals and the second conductive layer comprises a platinum-group metal.

5. The liquid-discharge-head substrate according to claim 1, wherein the plurality of conductive layers further include a third conductive layer that is more oxidizable than the second conductive layer, and wherein the common wiring line and the fuse each include the third conductive layer, the second conductive layer, and the first conductive layer stacked in that order from a side adjacent to the base in a direction in which the conductive layers are stacked on top of one another.

6. The liquid-discharge-head substrate according to claim 5, wherein the second conductive layer contains a platinum-group metal and the first and third conductive layers contain at least one material selected from the group consisting of Ta, Al, Ti, Cr, Mn, Fe, Ni, W, Si, and C.

7. The liquid-discharge-head substrate according to claim 5, wherein the first covering portion includes the second conductive layer and the third conductive layer, and wherein a part of the second conductive layer covering the first heating resistance element is exposed in an opening arranged in the first conductive layer.

8. The liquid-discharge-head substrate according to claim 1, further comprising:

a coating film covering the fuse and containing Si and C.

9. The liquid-discharge-head substrate according to claim 1, wherein current flowing through the fuse oxidizes at least part of the first conductive layer such that the first conductive layer has an electric resistance higher than that before the current flows through the fuse, thus blowing the fuse.

10. A liquid discharge head comprising:

a liquid-discharge-head substrate including:

a base including a first heating resistance element and a second heating resistance element that generate heat for liquid discharge;

a first covering portion covering the first heating resistance element and having electrical conductivity;

a second covering portion covering the second heating resistance element and having electrical conductivity;

an insulating layer disposed between the first heating resistance element and the first covering portion and disposed between the second heating resistance element and the second covering portion;

a fuse; and a common wiring line for electrically connecting the first covering portion and the second covering portion, the common wiring line electrically connected with the first covering portion via the fuse; and a passage forming member joined to the liquid-discharge-head substrate to form a passage, wherein the common wiring line and the fuse each have a multilayer structure including a stack of a plurality of conductive layers and the plurality of conductive layers include a first conductive layer and a second conductive layer that is less oxidizable than the first conductive layer.

11. The liquid discharge head according to claim 10, wherein the first conductive layer is located closer to the passage forming member than the second conductive layer.

12. The liquid discharge head according to claim 10, wherein the passage forming member has a through-hole or a recess that opens to the fuse and the through-hole or the recess overlaps at least a part of the fuse when viewed in a direction orthogonal to a surface of the base.

13. The liquid discharge head according to claim 10, wherein the fuse is covered by the passage forming member.

14. A method for manufacturing a liquid-discharge-head substrate that includes a base including a first heating resistance element and a second heating resistance element that generate heat for liquid discharge, a first covering portion covering the first heating resistance element and having electrical conductivity, a second covering portion covering the second heating resistance element and having electrical conductivity, an insulating layer disposed between the first heating resistance element and the first covering portion and disposed between the second heating resistance element and the second covering portion, a fuse, and a common wiring line for electrically connecting the first covering portion and the second covering portion, the common wiring line electrically connected with the first covering portion via the fuse, the method comprising:

stacking a plurality of conductive layers including a first conductive layer and a second conductive layer that is less oxidizable than the first conductive layer on the base; and forming the common wiring line and the fuse by etching the first and second conductive layers, the common wiring line and the fuse each having a multilayer structure including a stack of the first and second conductive layers.

15. The method according to claim 14, wherein the forming includes forming the first covering portion including at least either the first conductive layer or the second conductive layer.

16. The method according to claim 14, wherein the stacking includes forming the first conductive layer with a conductive material other than platinum-group metals and forming the second conductive layer with a platinum-group metal.

17. The method according to claim 14, wherein the stacking includes stacking a third conductive layer that is more oxidizable than the second conductive layer, the second conductive layer, and the first conductive layer in that order from a side adjacent to the base, and wherein the forming includes:

etching the first conductive layer, the second conductive layer, and the third conductive layer to form the common wiring line and the fuse, each having a multilayer structure including a stack of the first, second, and third conductive layers, such that the first, second, and third conductive layers cover the first heating resistance element, and removing part of the first conductive layer over the first heating resistance element.

18. A liquid-discharge-head substrate comprising:

a base including a first heating resistance element and a second heating resistance element that generate heat for liquid discharge;

a first covering portion covering the first heating resistance element and having electrical conductivity;

a second covering portion covering the second heating resistance element and having electrical conductivity;

an insulating layer disposed between the first heating resistance element and the first covering portion and disposed between the second heating resistance element and the second covering portion;

a fuse; and a common wiring line for electrically connecting the first covering portion and the second covering portion, the common wiring line electrically connected with the first covering portion via the fuse, wherein the common wiring line and the fuse each have a multilayer structure including a stack of a first conductive layer and a second conductive layer, the first conductive layer comprises a conductive material other than platinum-group metals, and the second conductive layer comprises a platinum-group metal.

19. The liquid-discharge-head substrate according to claim 18, wherein the first conductive layer comprises Ta and the second conductive layer comprises Ir.

* * * * *